United States Patent [19]

Ferrara

[11] 3,991,524

[45] Nov. 16, 1976

[54] VIBRATORY FINISHING EQUIPMENT

[75] Inventor: Achille K. Ferrara, Addison, Ill.

[73] Assignee: Ultramatic Equipment Company, Addison, Ill.

[22] Filed: July 10, 1975

[21] Appl. No.: 594,726

Related U.S. Application Data

[63] Continuation of Ser. No. 457,972, April 4, 1974, abandoned.

[52] U.S. Cl. ..... 51/163.1

[51] Int. Cl.[2] ..... B24B 31/06

[58] Field of Search ..... 51/163; 241/175

[56] References Cited

UNITED STATES PATENTS

| | | | |
|---|---|---|---|
| 3,093,940 | 6/1963 | Balz | 51/163 |
| 3,197,922 | 8/1965 | Smith | 51/163 |
| 3,341,978 | 9/1967 | Carstens | 51/163 |
| 3,541,738 | 11/1970 | Rampe | 51/163 |
| 3,552,068 | 1/1971 | Van Fossen | 51/163 |
| 3,623,706 | 11/1971 | Isaacson | 51/163 |
| 3,685,213 | 8/1972 | Rampe | 51/163 |
| 3,694,968 | 10/1972 | Isaacson | 51/163 |
| 3,793,780 | 2/1974 | Musschoot | 51/163 |

*Primary Examiner*—Harold D. Whitehead
*Attorney, Agent, or Firm*—Alter and Weiss

[57] ABSTRACT

Vibratory finishing equipment including a cylindrical drum having its axis set horizontally. The drum is resiliently mounted on a base. The base is equipped so that the drum can be tilted at a desired angle. The vibrators are mounted in an upper quadrant of the drum. The position of the vibrators in the upper quadrant of the cylindrical drum provides a unique combination of rotary, lateral and longitudinal motion which assures that all of the pieceparts are properly finished by the media within the drum.

12 Claims, 10 Drawing Figures

VIBRATORY FINISHING EQUIPMENT

This is a continuation of application Ser. No. 457,972, filed Apr. 4, 1974, and now abandoned.

This invention relates to vibratory drums used in finishing pieceparts. More particularly, to such vibrating equipment that constantly and automatically reuses the finishing media.

The deburrinng, abrading, grinding and finishing of pieceparts was originally a hand process. Automatic equipment such as rotating barrels were then used with finishing media therein to automatically process a plurality of pieceparts simultaneously by rotating the barrel, finishing media and the pieceparts therein to grind down, abrade, debur, or otherwise finish the pieceparts. Eventually, it was discovered that it was not necessary to rotate the barrels. It was found that by vibrating the container, even better results were obtained. When the finishing was accomplished by rotating the barrels, many times, the pieceparts themselves were damaged, by the sudden change in direction of the individual pieceparts in the barrels or drums. The vibratory motion of the barrel, on the other hand, induced each of the pieceparts and the finishing media to go into a rotary and revolutionary motion of different accelerations so that the pieceparts were rubbed and finished. However, many times, in the equipment presently available, portions of the media and especially the media in the upper quadrant, do not vibrate.

Also, many times the pieceparts are damaged even using the vibrators. The damage occurred because the induced rotary and revolutionary motion of the pieceparts and media has in the past also induced nodes in the longitudinal cross section of the media as it vibrates. At the nodes the pieceparts make relatively violent downward movement oftentimes being damaged thereby.

In addition, with vibrators at the bottom of the container, the containers assumed an elliptical vibratory motion. The elliptical motion tended to cause the pieceparts and media to be forced towards the less active quadrants of the containers, especially into the upper quadrants. Further, many times the vibration of the media and the pieceparts is such that there is not sufficient frictioinal contact between the pieceparts and the media.

Another problem with the presently available vibratory equipment is that of removing the media and the pieceparts from the drum to supply the drum with new pieceparts requiring finishing. This is often a time and labor consuming process notoriously adding to the expense of the finishing operation.

Still another problem with the presently available vibratory finishing equipment is that of properly timing the finishing process; that is, allot the right amount of time to properly finish the pieceparts. This is especially a problem wherein a continuous finishing process is used with the pieceparts being fed into the vibrating equipment along with media on a continuous basis at one end and being removed at the other end. Then, the speed or the duration of the finishing cycle must be a function of the actual frequency and intensity of vibration as well as the angle of inclination of a barrel or drum during the finishing process. The angle of inclination, of the drum, has until now either been fixed or varying the angle has taken an inordinate amount of time; and therefore, also added seriously to the costs of the finishing operation.

Accordingly, an object of this invnetion is to provide new and unique vibratory finishing equipment.

A further object of this invention is to provide vibratory equipment wherein the media and pieceparts are given the unique rotary, revolutionary and linear motion so that all of the pieceparts are frictionally in contact with the finishing media while the pieceparts travel through the drum. In this respect the nodes in the longitudinal cross sectional view of the contents of the drum, including the media, liquid and pieceparts, are practically totally eliminated.

A related object of the invention is to provide vibratory finishing equipment with the vibration inducing units attached to the upper quadrants of a cylindrical drum container resting with its longitudinal axis at an acute angle to the horizontal.

Still another related object of the invention is to provide vibratory finishing equipment that is sufficiently quiet to meet the Federal requirements.

Yet another object of the invention is to provide vibratory equipment wherein the actual vibrators are dual shaft counter-weighted rotating members, operated from a single motor removed from the actual vibrators and connected thereto by non-vibratory coupling means.

An ancilliary object of the invention is to provide vibratory finishing equipment which continuously is fed with finishing media and pieceparts and wherein means are provided for regulating the time it takes for an individual piecepart to transverse the vibrating equipment from one end to the other.

A more detailed object of this invention is to provide a drum container having four quadrants — two upper and two lower — wherein the actual vibration inducing equipment is in only one of the upper quadrants, and wherein there are resilient means used for mounting the drum container onto a base.

A further object of the invention is to provide discharge end plates for use in removing the media and pieceparts from the drum container which end plates take advantage of the linear motion imparted to the pieceparts and to the finishing media to facilitate the removal of the pieceparts and media from the drum container.

Yet another object of the invention is to provide vibration finishing equipment a minimal of horsepower in setting up the vibrations which activate the finishing media and the pieceparts to assure that the pieceparts are properly finished as they travel through the drum container.

In a preferred embodiment of the invention a cylindrical drum with its longitudinal axis approximately horizontal is resiliently mounted on to a base. The base is equipped so that a drum can be tilted to an angle giving a desired longitudinal speed to the media and the pieceparts travelling through the drum. Vibration inducing equipment is attached to the drum at only one of the upper quadrants of the drum. Preferably, the vibration equipment comprises eccentric counterweights mounted onto a dual axle arrangement which enables efficient control of the frequency and intensity of vibration.

The location of the vibration inducing equipment in the upper quadrant sets up rotating and revolutionary motion in the media and pieceparts. The contents of the container vibrate effectively without any node points from the input end to the discharge end of the drum container. The induced rotational motion of the contents is greatest near the vibrator and least at the bottom of the container, thereby minimizing damage to the pieceparts and extending the life of the motor and the container lining. At the discharge end an end plate is provided which takes advantage of the linear and revolutionary motion of the media and pieceparts to remove the media and pieceparts from the drum container; and also to separate them, sending the media back over a conveyor to the input end of the drum container, while the pieceparts are sent to the next operation. The height of the discharge aperture is valuable to enable another means of controlling the time required for the pieceparts and media to axially traverse the cylinder drum. Optionally, the size of the discharge aperture can be adjustable.

The above mentioned and other objects and features of the invention together with the manner of obtaining them will become more apparent and the invention itself will be best understood by making reference to the following description of the preferred embodiment of the invention taken in conjunction with the accompanying drawings in which.

Figures 1, 2, 2A:
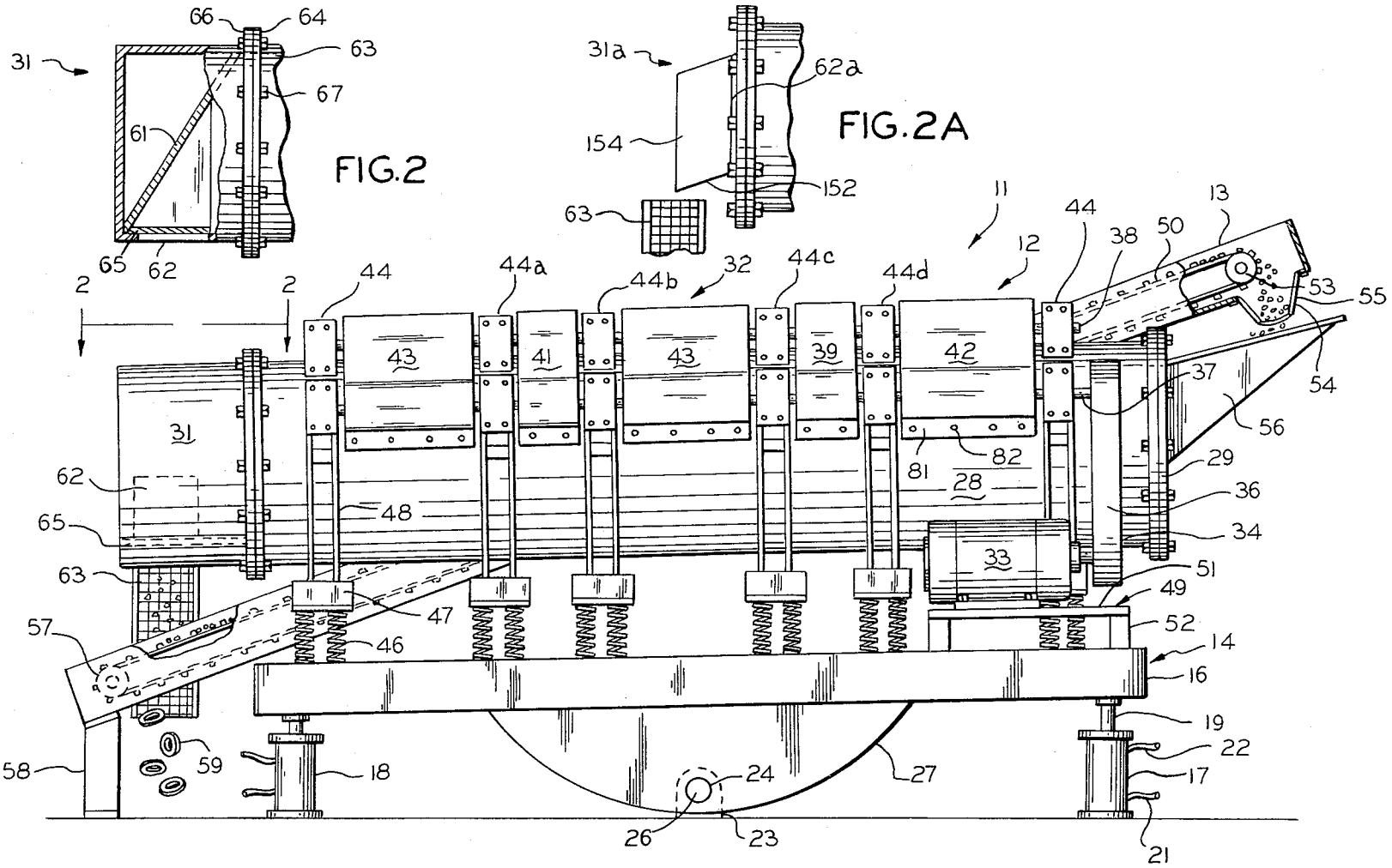
FIG. 1 is a side view of the vibratory finishing equipment.
FIG. 2 is a sectional view taken along lines 2—2 and looking in the direction of the arrows showing the mounting of the discharge plate used at the discharge end of the equipment.
FIG. 2A is a side view of an optional discharge end arrangment on the vibratory finishing equipment.

In FIG. 1 the vibration finishing equipment is shown in general at 11. It comprises a drum container assembly 12 and a return conveyor 13. The drum container assembly 12 is resiliently mounted on a base assembly 14.

The base assembly itself includes means for varying the angle of inclination of the longitudinal axis of the drum container. More particularly, the base unit comprises a horizontal slab, or frame unit, 16 mounted on dual pairs of hydraulic cylinders, such as cylinders 17 and 18. Each of the hydraulic cylinders, such as hydraulic cylinder 17, includes a piston, such as piston 19, which is controlled through input and output lines, (shown as 21 and 22 on cylinder 17). By operating valves (not shown) the piston 19 is extended from or returned into the cylinder to effect the angle of inclination of the drum container assembly 12. The valving arrangement is such that when the pistons at one end are being extended, the pistons at the other end are contracted. At the center thereof the base 16 is pivoted to trunions 23 and 23a mounted to ground. The trunions, such as trunions 23, have apertures, such as aperture 24 for receiving a pin, such as pin 26 therein. Means are provided for pivoting the base. For example, arcuate members 27 and 27a pivot about the pins and are attached to the slab 16 by welding or any other well known means. Thus, through the proper manipulation of the cylinder pairs, the angle of inclination of the drum container assembly 12 can be varied from the horizontal so that it has a positive angle of inclination; that is, with its input side higher than its discharge side, or it can have a negative angle of inclination; with its discharge side higher than its input side.

The drum container assembly 12 comprises the actual cylindrical container 28 having an input feed end plate 29 attached at the input thereto and a discharge end assembly 31 attached to the discharge side. The drum container assembly 12 also includes a vibrator unit 32 mounted on an upper quadrant of the drum. The vibrator units are actuated by a motor 33 which is coupled to the vibrator units through a belt drive assembly 34 including a belt cover 36. The belt drives a shaft 37 which is coupled to a second shaft 38. The vibrator units are coupled together by means, such as couplers 39 and 41. As shown in FIG. 1, there are three vibrator units 42,43 and 44. At both ends of each of the vibrator units are shown bearing equipment, such as bearing equipment 44 and 44a at the ends of vibrator 43. The drum container itself is resiliently mounted on the base slab 16 through means, such as coil spring 46, abutting angle iron 47 which is attached to belt strut unit 48, for example, in any well known manner.

The motor 33 is separated from the resiliently mounted drum and is mounted on its own platform assembly 49 having a horizontal table 51 and vertical standards attached thereto and dependent therefrom, such as vertical standard 52, which is attached to slab, 16, in any well known manner.

The conveyor 13 may be any well known type of conveyor, such as an endless belt conveyor, comprising a moving belt, such as belt 50 rotating around idle wheel 53 to drop the finishing media, such as shown at 54, through conveyor chute 55 into the input chute 56 mounted to end plate 29 of the drum container. The pieceparts to be finished are also dropped into the input chute 56. The endless belt rotates by drive wheel 57. The conveyor is mounted on any well known support, such as shown at 58.

At the discharge end of the drum container, means are provided for emptying the drum by directing the media 54 and pieceparts 59 from the drum. The media drops onto the conveyor 13 and the pieceparts, such as piecepart 59, are directed onto another conveyor or the next processing station.

More particularly, as shown in FIG. 2, the discharge end assembly 31 has therein an angle plate 61 positioned to take advantage of the combination of rotary and linear motion of the pieceparts and media to force the media and pieceparts out through opening 62 onto a chute 63. Without plate 61 the pieceparts and media tend to be trapped in the end assembly. The chute 63 has a mesh bottom where, for example, the media can fall through the mesh while the pieceparts are carried by the vibration of the entire equipment including the chute onto another conveyor, not shown. The end assembly 31 is attached to the main body of the drum container 63 using flanges 64 and 66 and threaded fasteners, such as shown at 67, for example. The threaded fasteners are at 15° intervals so that the discharge end assemlby can be rotated to vary the height of the opening 62. As the height increases the container contents "pile up". This changes the length of each cycle of the spiral path traversed by the drum contents;

and consequently, the frequency of the spiral vibration. Thus, another traverse time control is provided.

Figure 4A:
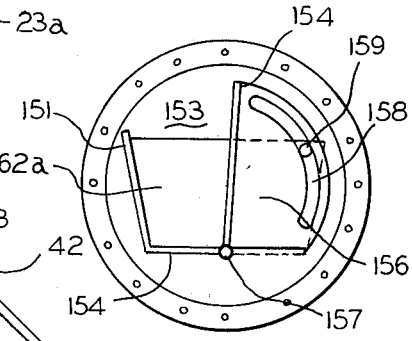
FIG. 4A is an end view of the optional discharge arrangement of the equipment.
Figure 4:
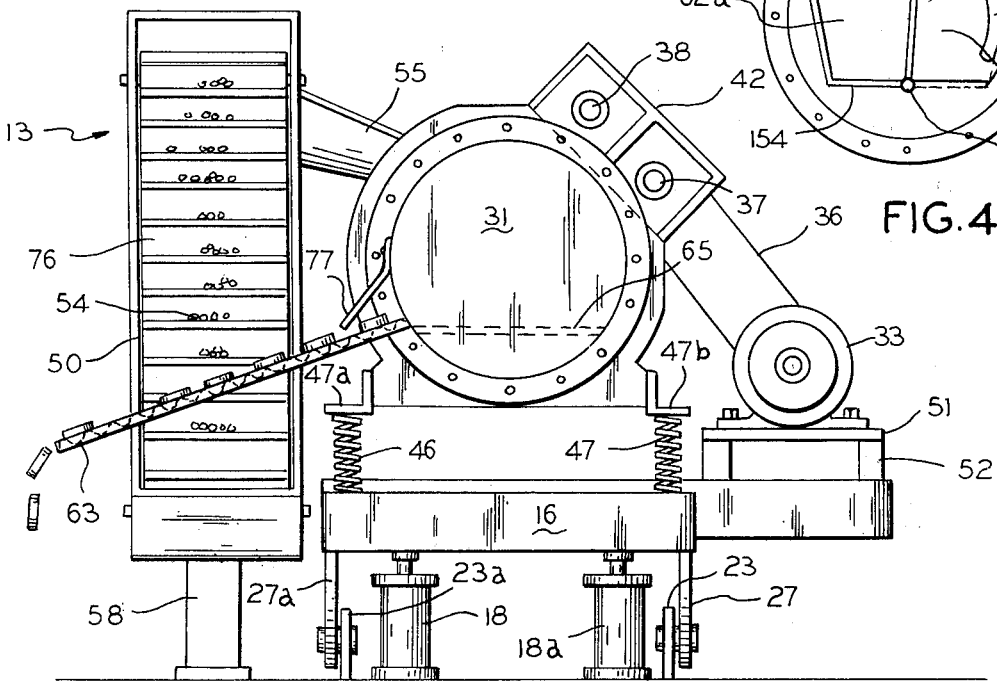
FIG. 4 is a view of the discharge end of the equipment.

Further, as seen in FIGS. 1, 2 and 4, a bottom plate arrangement 65, which extends along the bottom of opening 62 and back to the drum container to provide a "floor" for the drum contents, assures that the contents of the container are not trapped at the bottom of the discharge end assembly.

Figure 3:
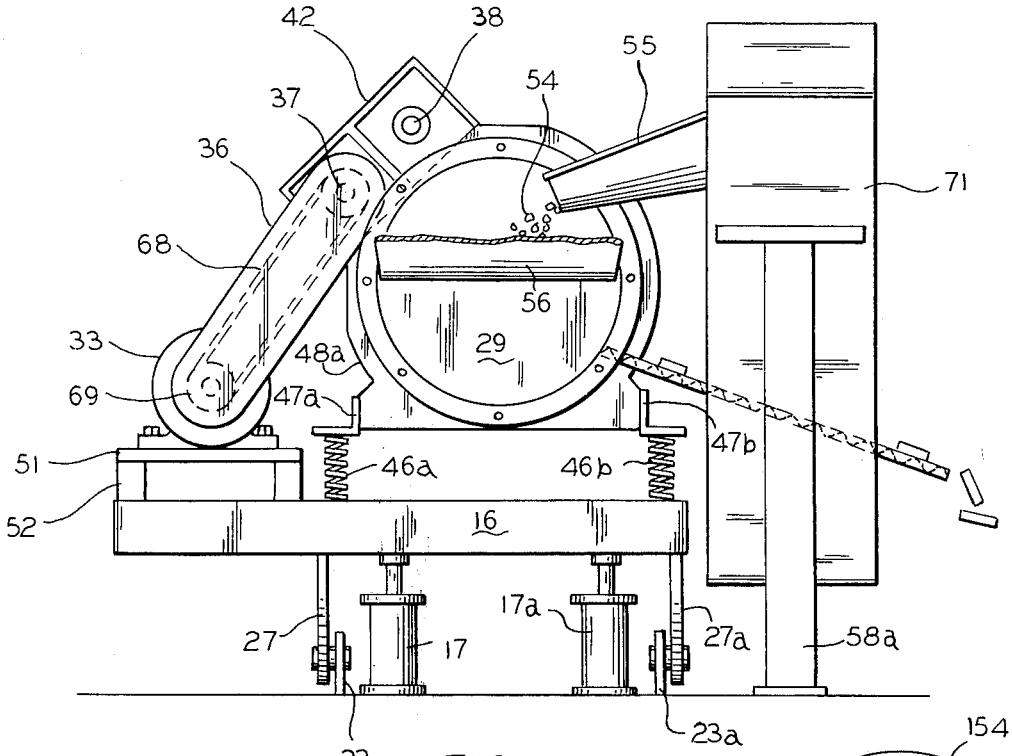
FIG. 3 is a view of the input end of the equipment.

From the view of the input end plate it is seen that chute 55 of the conveyor sends media 54 back into the input chute 56 of the end plate 29. FIG. 3 illustrates that the spring means, such as spring 46*a* abuts the angle iron 47*a*, while spring 46*b* abuts angle iron 47*b*. The angle irons are attached to the strut units 48 which surround the drum container and have a flattened portion at the bottom where they are attached to the angle irons.

The base plate is shown as a slab; however, it could assume other configurations, for example, it could be made up of angle irons welded together. The motor 33 drives belt 68 from drive shaft 69 to drive a vibration shaft 37 which is coupled to a second shaft 38 in the vibratory unit 42.

The conveyor is mounted on supports, such as 58 and 58*a*, and conveys the media from the discharge end back through chute 55 into the input chute 56. The conveyor is shown generally as 71. The hydraulic cylinders 17 and 17a operate simultaneously and synchronously with each other and with cylinders 18 and 18a at the other end of the base to rotate the base 16 about the trunions 23, 23*a* utilizing arcuate plates 27 and 27*a*.

The discharge end view of FIG. 4 again shows the base 16 having the motor unit 33 on the platform 51 supported by standards, such as standard 52. The motor unit 33 is coupled to the vibrator units by belt unit 36.

The conveyor 13 can be any well known conveyor. Here it is shown as having a ratcheted belt 50 having portions 76 for carrying the media back up to the chute 55. The opening in the end assembly 31 may be covered with a flexible covering 77.

Figure 5:
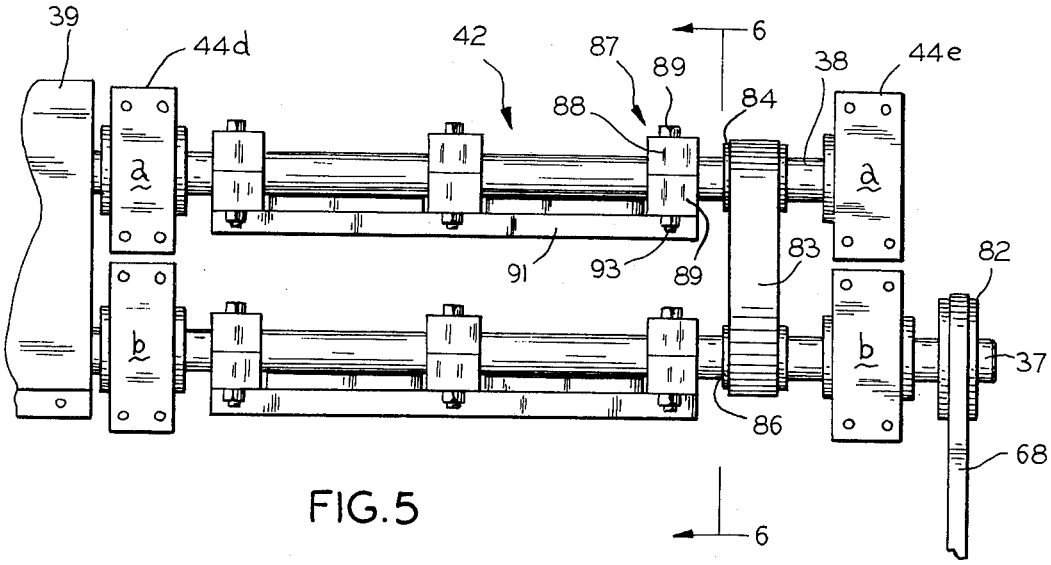
FIG. 5 is a detailed showing of the twin axle vibrators.
Figure 6:
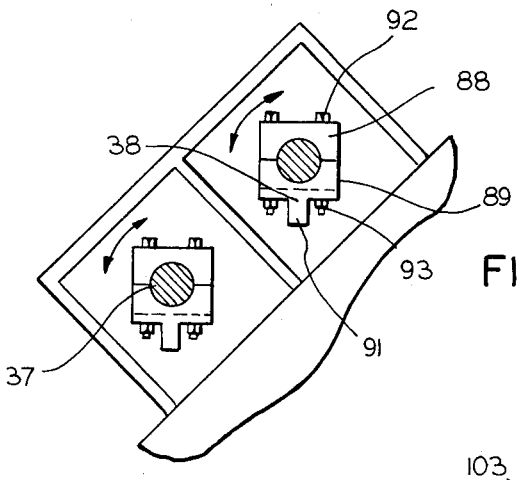
FIG. 6 is a sectional view taken through line 6—6 of FIG. 5 and looking the direction of the arrow.

A vibrator unit 42 is shown in greater detail with the cover removed in FIGS. 5 and 6. The cover is shown in FIG. 1 as having a flange 81 with apertures 82 therein for receiving threaded fasteners for attaching the cover to the actual drum container.

As can be seen in FIGS. 5 and 6 the drive belt 68 is attached to a driven wheel 82 affixed to shaft 37. It should be noted that the frequency of vibration is determined and can be adjusted by the ratio of the motor drive wheel to the driven wheel 82 on shaft 37. The proportional sizes of the motor drive wheel 69 and the shaft driven wheel 82 determines the rate of rotation of shaft 37, and consequently, of shaft 38. The rate of rotation of these shafts can also be varied by changing the motor speed.

The shafts 37 and 38 go through bearing assemblies, such as bearing assembly 44*e* to protect the shafts from the vibratory motion of the drum on which the shafts are attached.

The shafts 37, 38 are coupled together through means, such as drive coupling belt 83, which is attached at drive belt seat portions of the shafts 84, and 86, respectively. The actual counter-weight vibrator arrangement of vibrator unit 42 is shown with the cover removed in FIGS. 5 and 6. Means are provided for clamping weights to the shafts. More particularly, clamps, such as clamp assembly 87, is provided. The clamp assembly 87 comprises a clamping side 88, and a weight holding side 89. Attached directly to the weight holding side is the weight 91. The weight 91, shown as being integral to the weight holding portion 89, is preferrably made of lead and fused directly to the weight holding portion 89. The clamp is bolted around the shaft 38 using threaded fasteners, such as bolt 92 and nut 93, for example. A feature to be noted with regard to the weights are that they extend over relatively long sections of the container. This feature aids in preventing nodes in the cross-sectional view of the moving contents of the vibrating container.

Three such clamping portions are shown around each shaft of the vibrator. It should be noted that while in FIG. 6 the vibrators are shown having weights attached to the two shafts in the same sections thereof, the frequency of vibration can be varied by varying the position of each of the counter-weights around the shafts. This is readily done by loosening the bolts and nuts and tightening them again in the position desired. Also, the weight 91 can be readily varied to change the frequency of vibration of either or both of the weights.

The possible variations in the position of the weights is indicated by the arrows above the counter-weights in FIG. 6.

A second pair of bearing blocks, such as bearing block 44, are shown on the other side of the counter-weighted vibrator units 42.

Figure 7:
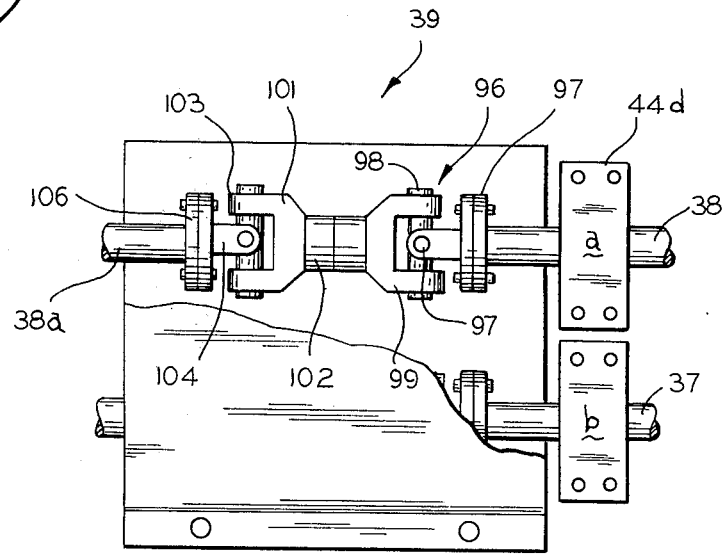
FIG. 7 is a cut-away view showing the coupling between the vibrators.

Following the second pair of bearing blocks is a coupler arrangement 39. The coupler arrangement is shown in greater detail in the cut-away drawing of FIG. 7. Therein is shown the bearing block 44*e* (*a* and *b*) around shafts 38 and 37, respectively. The shafts 38 and 37 are coupled to the knuckle type coupler shown generally at 96, through a flange bolt arrangement 97. The knuckle coupler 96 has a pivot point at 97 attached to a pin 98 going through a bifurcated knuckle element 99. This arrangement is repeated on the other side so that another knuckle element 101 is attached through shaft 102 and to shaft 38a using a pin 103 and pivot arrangement 104, as well as a flange coupling arrangement 106.

While this type of coupling arrangement is shown, it should be recognized that any type of coupling arrangement which enables there to be some play between the actual solid shaft 38 of the counter-weighted vibrator unit 42 and the next counter-weighted vibrator unit could be used.

Figure 8:
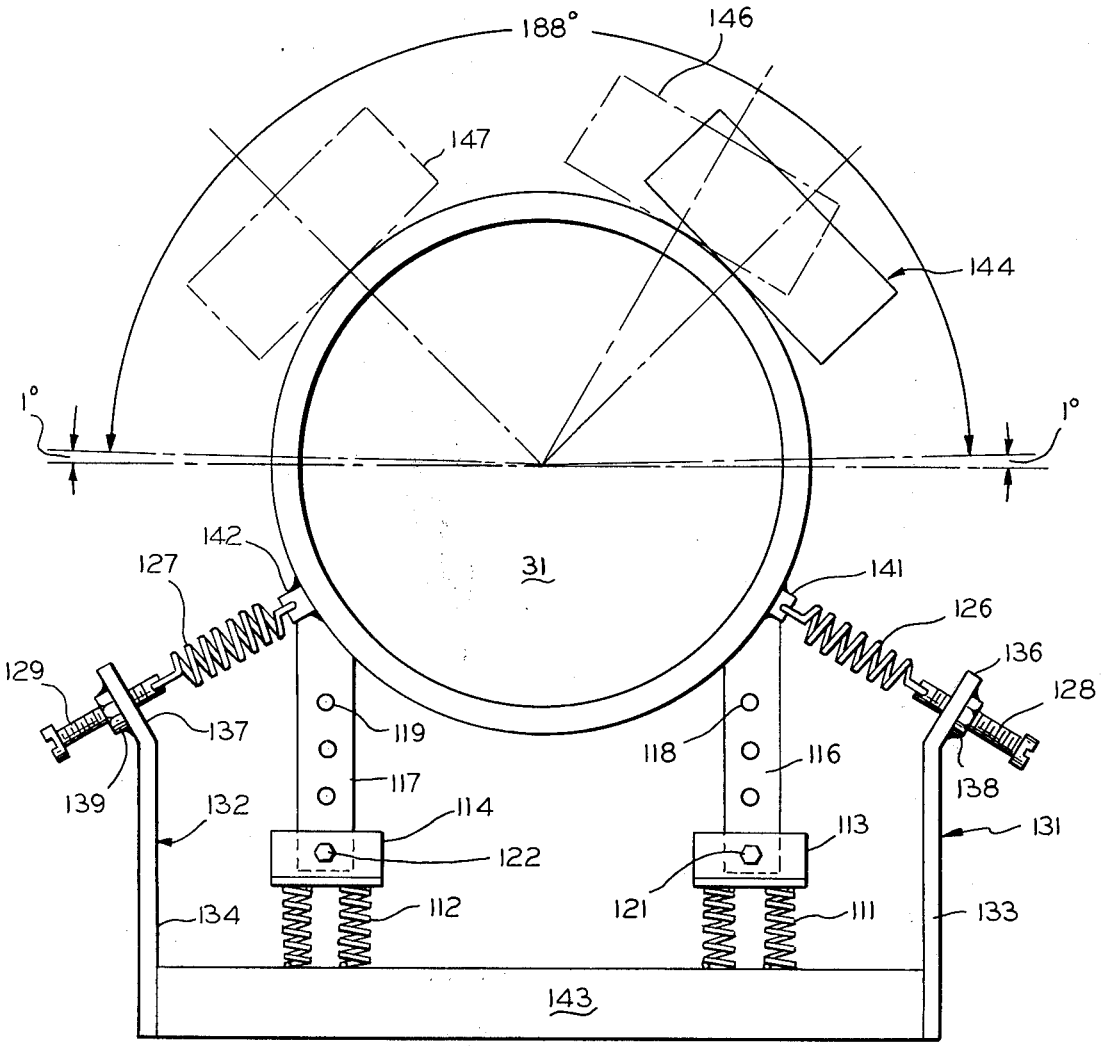
FIG. 8 is a schematic showing of the location and mounting of the vibrators of the vibration equipment.

FIG. 8 constitutes another embodiment of the invention. As shown therein a drum container 31 is reiliently mounted on spring pairs, such as 111 and 112. The spring pairs are connected to spring supports, such as angle irons 113 and 114, respectively. The angle irons are attached to drum supports or standards, 116 and 117.

A key feature of these supports or standards is a series of apertures, therein such as apertures 118 and 119 on standards 116 and 117, respectively. The apertures are used when coupling the standards to the spring supports 113, 114 using threaded fasteners or the like shown at 121 or 122. With the series of apertures the height of the drum container 31 above the resilient mounting can be varied. This change in height in turn varies the frequency of vibration of material in drum 31.

The frequency of vibration can be further varied utilizing variable springs 126 and 127. The springs 127 and 126 can have their tension varied using screw arrangements 129, and 128, respectively. The variation in the resiliency is used to set the resiliency to attain a natural resonant point of the vibrating drum and contents. This further reduces the power requirements and noise level of the equipment.

The screw arrangements are attached to one end of the spring 126 and 127, and pass through angle irons 131 and 132, respectively. The angle irons each have vertical portions 133 and 134 which are welded to an angle portion 136 and 137, respectively. Nuts 138 and 139 for threadingly receiving the screws 128 and 129 are attached to the angle portions by welding, or the like. The other ends of the springs 126 and 127 are attached to apertured anchor irons 141 and 142 that are welded or otherwise attached to the outer periphery of drum 31.

The angle irons 131 and 132 are each attached to the base 143 which may be an angle iron of some kind, such as an I beam or a slab. The vibratory equipment 144 is shown connected onto an upper quadrant of the drum 31. As indicated in the drawing, the vibrating units can be placed within the upper 178° of the upper quadrants. This is shown by dashed line showing of vibrator units 146 and 147, for example.

FIGS. 2A and 4A show optional discharge end assembly 31a. In the assembly of FIG. 4A the opening 62a is in the flange plate rather than on the side. Duct means are formed by side plates 151 fixedly attached to bottom plate 152 and by movable side plate 154. The side plate 151 and the bottom plate 152 are fixedly attached to end plate 153 along the periphery of opening 62a. The duct leads contents of the container directly to chute 63.

Gate means are provided for selectively adjusting the size of opening 62*a*. More particularly, gate plate 156 covers a selected portion of opening 62*a*. Plate 154 is fixedly attached to gate plate 156. The assembly of plates 154 and 156 are pivotally coupled to bottom plate 152 by hinge means 157.

The gate plate has a slot 158 therein. Means such as thumb screw 159 pass through the slot 158 and thread into plate 153. This arrangement is used to secure gate plate 156 at a desired position thereby adjusting the size of opening 62a. The size of the opening affects the back-up of the contents of the container and consequently controls the length of the spirals in the contents. The spirals occur as a result of the combined longitudinal and revolutionary motion of the contents.

Ideally, the longitudinal cross section of the spiral should have no nodes. This equipment induces spiral motion effectively having no nodes. The motion of the drum is such that the contents are at the greatest agitation at the top side where the gravitational forces are the least; and therefore, piecepart damage is minimized while media life is maximized.

It should be understood that while a continuously cycling cylindrical container has been shown and described, the invention also applies to other type containers, for example, to batch containers.

Thus, in accordance with the description herein the mode of vibration that is the amplitude and/or frequency of vibration or the time for traversing the length of the cylinder can be selectively changed by varying the speed of the drive motor 33, by varying the proportions of the drive wheels leading from the motor to the twin shafts of the vibratory equipment, by varying the positions of the weights on the vibratory equipment, by varying the height of standards 116 and 117, by varying the resiliency of the springs, by varying the angle of inclination of drum container 31, by varying the height of discharge opening, by varying the size of the discharge opening, or by any combination of the aforementioned methods of changing the the amplitude, frequency or cycle time.

In operation, then, the finishing media and pieceparts to be finished are placed into the input end of the drum container. The variables are set to select a desired amplitude and frequency of vibration and a desired time of a cycle. For example, the drum is set at the angle of inclination desired to provide the time cycle desired for the finishing operation.

The vibratory equipment is started which causes the media and pieceparts to pass through the drum to the discharge end. At the discharge end the pieceparts and media are forced out of either the front opening 62a or the side opening 62, as selected, onto the meshed chute 63. The vibrations on the meshed chute 63 cause the media and pieceparts to pass thereover with the media falling through the mesh onto the conveyor 13 that brings the media back into the input chute at the input of the drum. The finished pieceparts are sent onto the next operation such as packaging.

While the principles of the invention have been described above in connection with specific apparatus and applications, it is to be understood that this description is made only by way of example, and not as a limitation on the scope of the invention.

I claim:

1. Vibratory finishing equipment for finishing pieceparts, said vibratory finishing equipment comprising a cylindrical container having its longitudinal axis in a horizontal plane, said container having circular walls, an input end and a discharge end, axial motion inducing means for inducing axial motion of the contents from the input end to the discharge end when the container is vibrated, vibration inducing means for causinng the container to vibrate, said vibration inducing means mounted on said circular walls at only either one of the upper quadrants of said cylindrical container where the upper quadrants are above the horizontal plane, no part of said vibration inducing means being located on or below the horizontal plane, and said vibration inducing means agitating the container to cause the pieceparts and media to be actuated to the maximum rotatable motion in the vicinity of the vibration inducing means and to the minimum rotatable motion on the side of the container directly opposite said vibration inducing means whereby a maximum circular motion is obtained in the vicinity of the vibration inducing means and a minimum circular motion is obtained at the bottom of said container opposite the vibration inducing means.

2. The vibratory finishing equipment of claim 1 wherein said axial motion inducing means comprises means for adjusting the angle of inclination of the longitudinal axis of said container.

3. The vibratory finishing equipment of claim 2 wherein said container is resiliently mounted to a base, wherein said means for varying the angle of inclination comprises fluid cylinder means at both ends of said base, and means for raising the pistons of the cylinder means at either end of the base to thereby vary the angle of inclination of the longitudinal axis of the container.

4. The vibratory finishing equipment of claim 3 wherein said base is centrally pivoted, whereby said container pivots when said cylinders are operated to vary the angle of inclination of the longitudinal axis of said container.

5. The vibratory finishing equipment of claim 1 wherein diagonal plate means are mounted at the discharge end of said container to direct the media and pieceparts to said discharge aperture, means for separating the media from the pieceparts, and means for transferring the separated media from the discharge aperture to the input aperture.

6. The vibratory finishing equipment of claim 1 wherein said discharge end of said container has a removable plate thereon that is intersected by the longitudinal axis, said discharge aperture being in a removable plate, and gate means for varying the size of said discharge aperture to thereby change the period of the spiral motion of the media and pieceparts.

7. The vibratory finishing equipment of claim 6 wherein said discharge aperture is in the side wall of said container, and means for varying the height of said discharge aperture, to thereby change the period of the spiral motion.

8. The vibratory finishing equipment of claim 1 wherein said vibration inducing equipment comprises a pair of parallel spaced apart shafts, means for mounting eccentric weights to each of said shafts, and means for causing said shafts to rotate thereby inducing vibrations in said container.

9. The vibratory finishing equipment of claim 1 wherein means are provided for independently varying the weights of each of said shafts to thereby change the amplitude of vibration of said container.

10. The vibratory finishing equipment of claim 9 wherein means are provided for independently varying the position of the eccentric weights on each of said shafts to thereby vary the amplitude of vibration of said container.

11. The vibratory finishing equipment of claim 1 wherein said container is a substantially closed cylindrical container, input aperture means in one end for placing media and pieceparts in said container, and discharge aperture means below said input aperture means at the discharge end of said container in the quadrant opposite the upper quadrant in which the vibration inducing means is mounted at a point to facilitate the exit of the pieceparts while in the minimum circular motion.

12. Vibratory finishing equipment for finishing pieceparts, said vibratory finishing equipment comprising a closed drum-like container having cylindrical walls forming a circle-like cross section, said container mounted with its longitudinal axis being approximately horizontal, input aperture means on one end of said container for placing media and pieceparts in said container, discharge aperture means in a bottom quadrant of said circle-like cross section at the side of the other end of said container for enabling the removal of the media and the pieceparts, vibration inducing means mounted in only one of the upper quadrants of the circle-like cross section of said container where the upper quadrants are above a horizontal plane through the center line of the container for applying a force to the container to cause said container to vibrate and to move the contents of the container along the length of the container from the input aperture means to the discharge aperture means in a spiral motion with the pieceparts and media having a maximum rotatable motion in the said one upper quadrant and a minimum rotatable motion at the opposite quadrant, and the other end of said container containing the discharge aperture being rotatable for varying the height of said discharge aperture.

* * * * *

UNITED STATES PATENT OFFICE

CERTIFICATE OF CORRECTION

Patent No. 3,991,524 Dated Nov. 16, 1976

Inventor(s) ACHILLE K. FERRARA

It is certified that error appears in the above-identified patent and that said Letters Patent are hereby corrected as shown below:

| | | |
|---|---|---|
| Col. 1, | line 9 | "deburrinng" should be -- deburring -- |
| 1 | 49 | "supply" should be -- resupply -- |
| 2 | 1 | "invnetion" should be -- invention -- |
| 2 | 46 | After "equipment" insert -- requiring -- |
| 5 | 18 | After "plate" insert -- 16 -- |
| 5 | 33 | After "33" insert -- mounted -- |
| 6 | 17 | After "frequency" insert -- and amplitude -- |
| 6 | 50 | "reiliently" should be -- resiliently" |
| 8 | 41 | "causinng" should be -- causing -- |

Signed and Sealed this

Fifteenth Day of March 1977

[SEAL]

*Attest:*

RUTH C. MASON
*Attesting Officer*

C. MARSHALL DANN
*Commissioner of Patents and Trademarks*